United States Patent [19]

Schwab et al.

[11] Patent Number: 4,735,688

[45] Date of Patent: Apr. 5, 1988

[54] DEVICE FOR SCRAPING A DOCTOR BLADE

[76] Inventors: Albert J. Schwab, 3076 N. Lexington, St. Paul, Minn. 55113; Altin J. Olson, 44190 Comsigne Dr., Hemet, Calif. 92344

[21] Appl. No.: 77,452

[22] Filed: Jul. 24, 1987

[51] Int. Cl.[4] ..... D21G 3/00

[52] U.S. Cl. ..... 162/272; 15/256.5; 15/256.51; 100/174

[58] Field of Search ..... 162/272, 281; 15/256.5, 15/256.51, 256.6; 100/174

[56] References Cited

U.S. PATENT DOCUMENTS

| | | | |
|---|---|---|---|
| 3,292,201 | 12/1966 | Bedard | 15/256.51 |
| 3,687,730 | 8/1972 | Murphy et al. | 162/272 |
| 4,265,705 | 5/1981 | Pyykonen | 162/272 |

*Primary Examiner*—S. Leon Bashore
*Assistant Examiner*—K. M. Hastings

[57] ABSTRACT

For the purpose of cleaning the doctor blade of a roller of a paper mill, a blade scraping device mounted upon an end of the frame retaining the doctor blade, the device having spring loaded scraping jaws between which the blade is drawn upon being withdrawn from its operating position.

3 Claims, 3 Drawing Sheets

DEVICE FOR SCRAPING A DOCTOR BLADE

BACKGROUND OF THE INVENTION

1. Field of Invention

This invention relates to a device for scraping the doctor blade of a roller in a paper mill.

2. Description of the Prior Art

The rollers in a paper mill may be on the order of ten to twenty six feet in length and doctor blades coextensive therewith are mounted adjacent thereto to scrape the roller clean of foreign material deposited thereon from the surface of the web of paper being formed passing thereover. The blade accumulates the material scraped from the roller and this material gathers and hardens upon the leading edge portion of the doctor blade.

The doctor blade must be scraped clean frequently. There has been very little advance in the art for this purpose. The operator in the scraping operation in practice is required to remove the blade from its holding frame by manually pulling the blade endwise out of its frame and then simply laying it on the floor. Then armed with a scraper such as a chisel, the blade is scraped clean by hand. The material on the blade becomes so hardened that it is not unusual that much of it must be scraped by applying a mallet to the chisel.

Scraping a doctor blade is hard manual labor and considerable floor space is required upon which to rest the blade while it is being scraped. This is an expensive procedure in considering the loss of operating time while the blade is being scraped.

It is the purpose herein to provide a mechanical device to replace and to expedite hand effort cleaning a doctor blade.

SUMMARY OF THE INVENTION

This invention represents improvement in the art of scraping clean a doctor blade as used in a paper mill.

It is an object of the invention herein to provide a device including a pair of scraping jaws between which a doctor blade may be drawn to be scraped clean.

It is a further object of this invention to provide a device which may be mounted onto the end portion of the frame retaining the doctor blade, the device being arranged to have the doctor blade drawn therethrough from its operating position and thus becoming scraped clean in an expedited operation.

More specifically, it is an object of this invention to provide a doctor blade scraping device having a base adapted to be removably mounted upon the end portion of the frame member retaining a doctor blade in operating position, said device having a pair of spring loaded jaws in alignment with the leading edge portion of the doctor blade whereby said blade is withdrawn from its operating position endwise between the jaws of said device to be scraped clean thereby and the blade may then be returned to its operating position. The only manual requirement here is the withdrawal of the blade through the jaws of the device.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
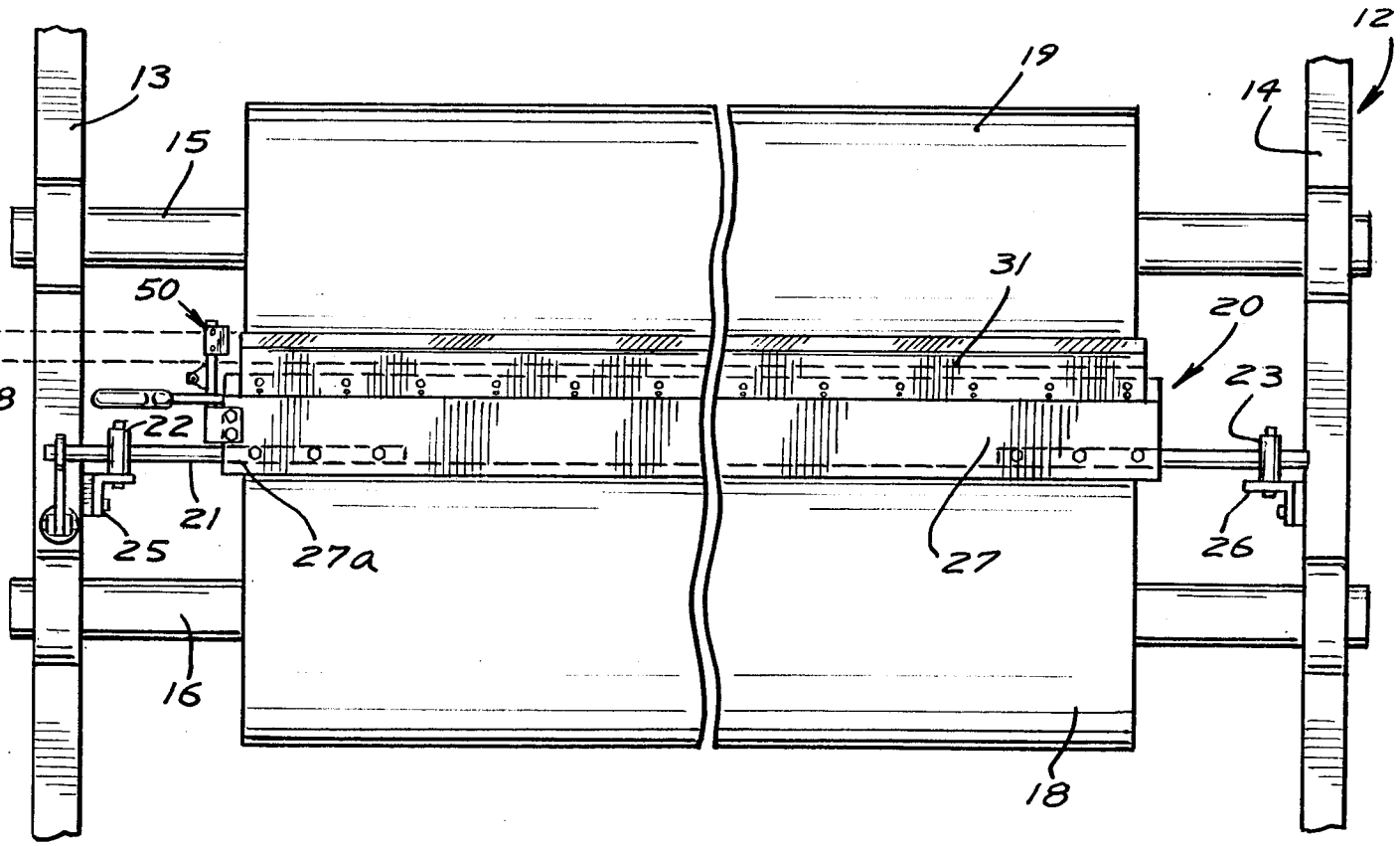
FIG. 1 is a view in side elevation of the invention herein in operating position.
Figure 2:
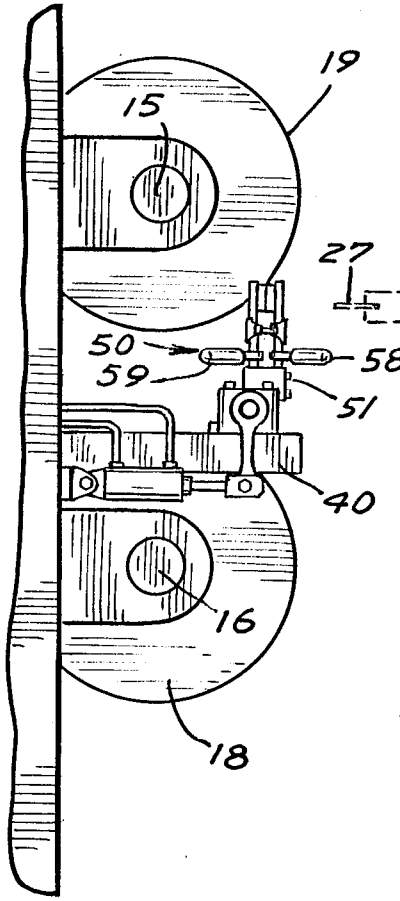
FIG. 2 is a view in rear elevation of the invention herein.

Referring to the drawings, the device herein is indicated generally by the reference numeral 50.

The device comprising the invention herein is particularly adapted to scrape clean the leading edge portion of a doctor blade which is used to scrape clean the rollers in a paper mill over which passes a web to be formed into paper. The web prior to becoming stabilized deposits foreign material on the rollers over which it passes and such foreign material is removed by doctor blades.

The material removed by the doctor blades accumulates and hardens onto the leading edge portion thereof and requires periodic removal. It is well to bear in mind that rollers in a paper mill may be on the order of ten to twenty six feet in length and the doctor blades have a corresponding length.

To place the device herein in an operating position, FIG. 1 shows a framework 12 having side frame members 13 and 14 which have journaled therebetween shafts 15 and 16 which respectively support rollers 18 and 19.

Supported on said side frame members and extending therebetween is the structure 20 which retains a doctor blade 35.

Figure 6:
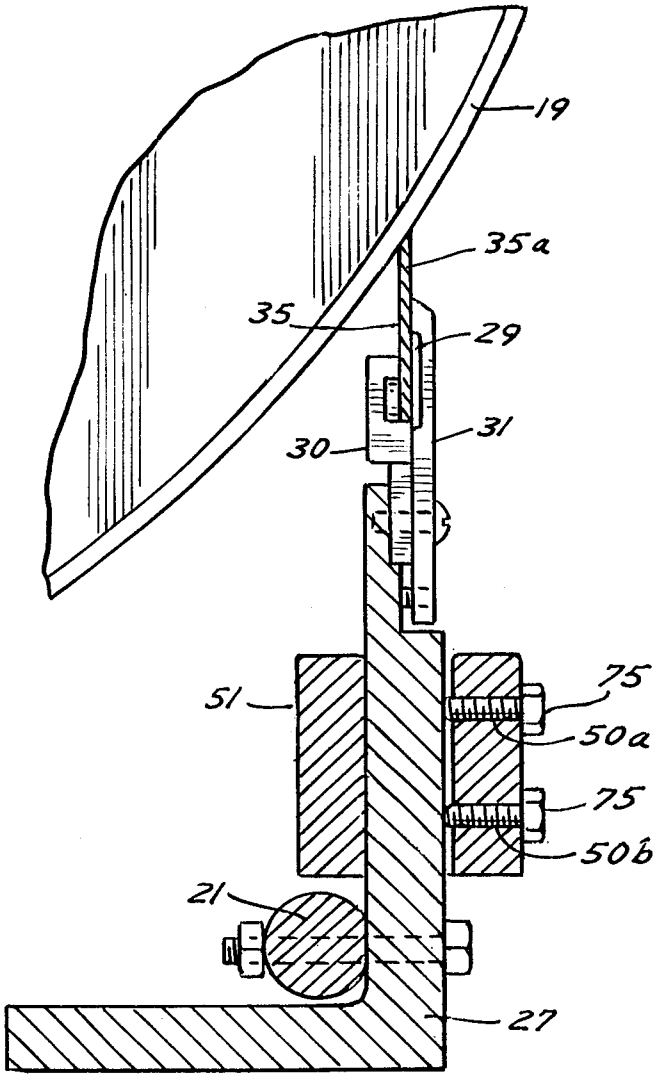
FIG. 6 is a view in vertical section taken on line 6—6 of FIG. 4 as indicated.

Said blade holding structure 20 comprises a journal 21 disposed in bearings 22 and 23 supported by brackets 25 and 26. Mounted on said journal and extending therealong is an angled blade holder 27 which receives the doctor blade therein in an appropriate slot 29 between spaced holding members 30 and 31 (FIGS. 5 and 6) which are adjustable to tilt the blade. The blade 35 is inserted endwise between said holding member 30 and 31. Said blade is formed as a flat elongated plate member of small thickness and having a leading scraping edge 35*a*.

A crank 40 is mounted onto the frame member 13 and the journal 21 extends through said crank and is pinned thereto as at 37 whereby said crank may tilt the blade holder and the blade therein.

The above blade holding structure described is a state of the art apparatus.

Figure 5:
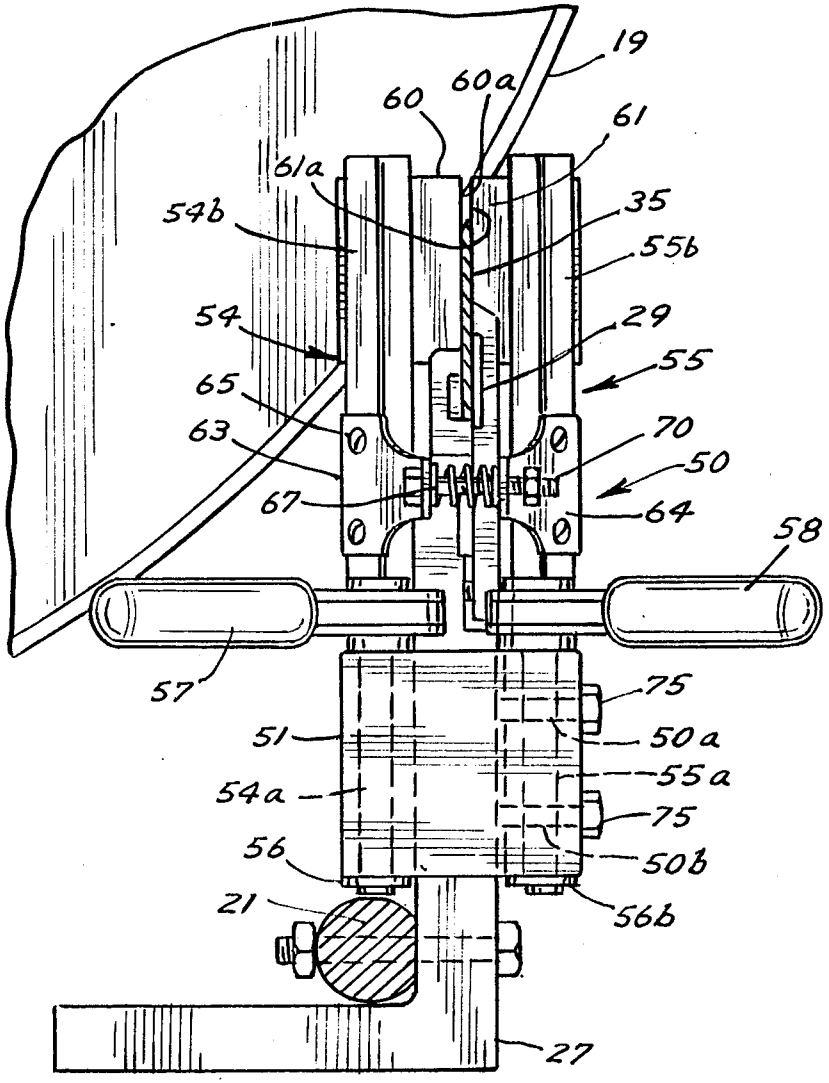
FIG. 5 is a view similar to that of FIG. 2 on an enlarged scale.

In FIG. 5, the doctor blade 35 in an end view is shown relative to the scraping device 50 in its operating position.

With reference to the several views, the device comprising the invention herein will now be described. As viewed in FIG. 1, the left end portion 27*a* of the blade holder 27 extends outwardly of the rollers 18 and 19 and said device as will be described is mounted thereon just above the journal 21.

The device 50 comprises a base 51 which is here shown substantially in the form of a cube having an open front central slot or recess 52 in one side thereof fronting on a back wall portion 53. Said base is tapped at 50*a* and 50*b* to receive set screws in line with said slot. Extending upwardly through said back wall portion in spaced relation are a pair of shafts 54 and 55 which have cylindrical bottom portions 54*a* and 55*a* journaled through said back wall portion 53 of said base 50. Said shafts extend through the bottom of said base sufficiently to be secured by C type spring clips 56 and 56*b*. The upper portions 54*b* and 55*b* of said shafts 54 and 55 are rectangular in cross sections. Secured to said shaft portions 54*b* and 55*b* in a suitable manner are a pair of diverging handles 57 and 58.

Figure 3:
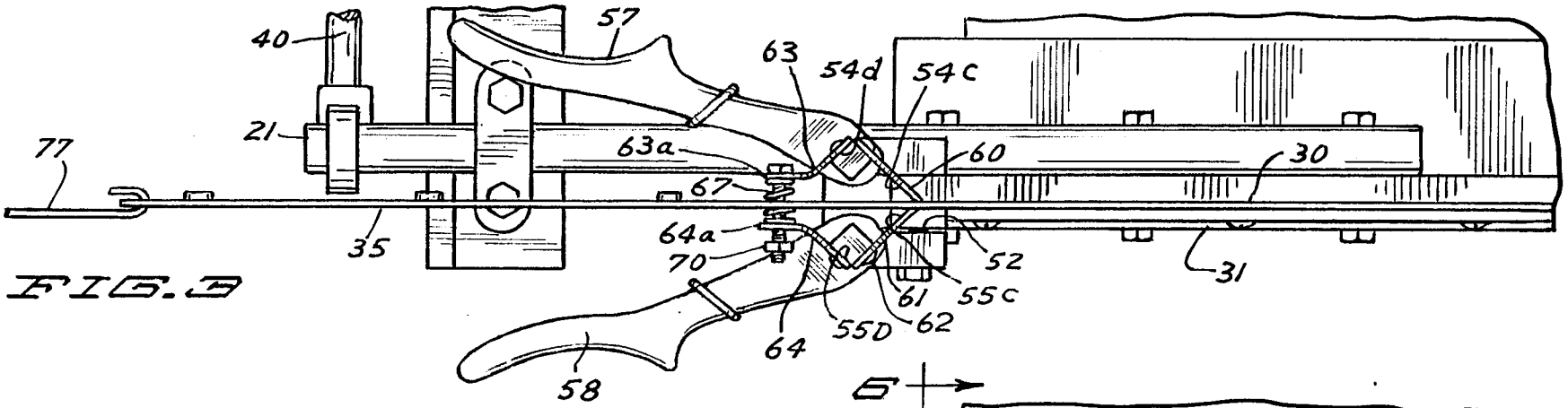
FIG. 3 is a top plan view of the invention herein in operating position.
Figure 4:
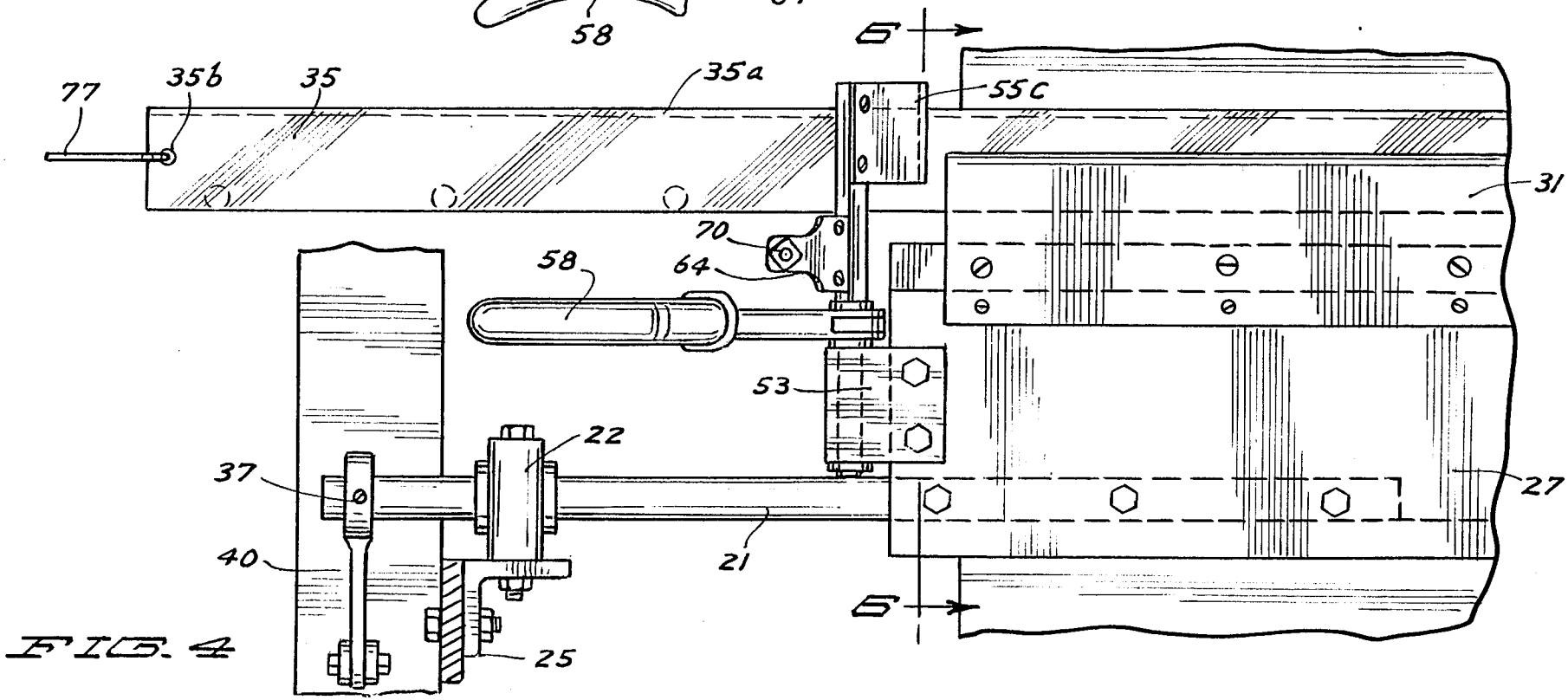
FIG. 4 is a view in side elevation on an enlarged scale.

Said upper portions of said shafts are axially arranged to have their respective faces 54*c* and 55*c* disposed in planes which will intersect forwardly thereof. Secured to said faces 54*c* and 55*c* are plate members 60 and 61 of suitable tempered metal having adjacent scraping edges 60*a* and 61*a*. Said plate members are shown secured by bolts 62 and are referred to as scraping blades. On the rear faces 54*d* and 55*d* of said shafts bracket plates 63 and 64 are secured by bolts 65. Said plates have converging projections 63*a* and 64*a* between which is disposed a coil spring 67 under substantial compression and being secured by having a bolt 70 extend therethrough and through said projections. The compression of said spring causes the leading edges of the scraping blades 60 and 61 to have a very tight spring loaded angular engagement as shown in FIG. 3.

To be mounted into operation position, the open slot 52 of the base 51 fits over the end portion 27*a* of the blade holding member 27 and is secured in position by set screws 75.

It will be noted that the doctor blade 35 has an aperture 35*b* through its left end portion as viewed in FIG. 1. The doctor blade as retained in its holder 27 is freely withdrawn endwise. A suitable pulling member such as a common type of bale hook 77 is hooked through said aperture and the blade is withdrawn. Simultaneously with the withdrawal of said doctor blade, the handles 57 and 58 are squeezed together to separate the leading or scraping edges of the scraping blades and the leading end of the doctor blade is positioned therebetween. The handles are then released to have the pressurized scraping edges 60*a* and 61*a* engage the leading or scraping edge portion of said doctor blade.

The doctor blade is then withdrawn from its operating position by being pulled against the scraping pressure of said scraping edge portions 60*a* and 61*a*. The device 10 is positioned to have the blade members 60 and 61 horizontally aligned to engage the scraping edge portion of said doctor blade.

It has been found that the blade is scraped clean by being pulled or drawn once between the scraping blades 60 and 61. There is no need to lay the blade upon the floor to be scraped as has been the prior art practice. The scraping of the doctor blade is efficiently and expeditiously accomplished at the cost of a very minimum down time. The blade may be immediately returned to its operating position for the resumption of work.

What has customarily been a laborious hand scraping operation has been converted to a hand assisted machine operation by means of which a doctor blade is quickly cleaned and returned to its operating position.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is

1. A cleaning device for the doctor blade of a roller in a paper mill in connection with a mounting upon a framework which retains the doctor blade in operating position, having in combination a base member rectangular in cross section, an open ended slot recessed into one side of said base member, said slot having side walls, a pair of spaced shafts journaled into said base member and having upper portions upstanding therefrom, a blade member mounted upon each of said shafts in an angular relationship to one another to have engaging free end portions, a pair of brackets mounted upon said shafts in directions oppositely that of said blades, said brackets having converging free end portions, a compression spring disposed between said converging free end portions, means securing said spring in operating position whereby the free ends of said blades are normally urged into engagement under significant pressure, a pair of diverging handles mounted on said shafts which upon being squeezed together cause said blade edges to separate to permit insertion of the doctor blade, means mounting said device upon the framework which retains the doctor blade.

2. The combination of claim 1, wherein said side walls are tapped to receive set screws, and said base slot receives an end portion of the doctor blade retaining framework, said base being secured by said set screws.

3. The combination of claim 1, wherein said upstanding upper portion of said shafts are rectangular in horizontal section.

* * * * *